United States Patent [19]

Anderson

[11] Patent Number: 5,022,204

[45] Date of Patent: Jun. 11, 1991

[54] WINDOW AND DOOR TRIM FOR USE WITH SIDING

[76] Inventor: Carl E. Anderson, c/o Alum-A-Pole Corporation, 2589 Richmond Ter., Staten Island, N.Y. 10303

[21] Appl. No.: 333,461

[22] Filed: Apr. 5, 1989

[51] Int. Cl.[5] ..... E06B 1/04

[52] U.S. Cl. ..... 52/211; 49/504

[58] Field of Search ..... 52/211, 656; 49/504, 49/505

[56] References Cited

U.S. PATENT DOCUMENTS

| | | | |
|---|---|---|---|
| 908,858 | 6/1909 | Goddard | 52/211 |
| 2,454,523 | 11/1948 | Philip | 49/504 |
| 2,902,727 | 9/1959 | Samolis | 52/656 |
| 2,973,809 | 3/1961 | Sklar | 49/504 |
| 3,119,155 | 1/1964 | Schlegel | 49/505 |
| 3,401,487 | 9/1968 | Brandt et al. | 52/211 |
| 3,826,050 | 7/1974 | Schwartz et al. | 49/505 |
| 4,389,824 | 6/1983 | Anderson | 52/211 |
| 4,467,576 | 8/1984 | Burgers | 49/505 |

FOREIGN PATENT DOCUMENTS

| | | | |
|---|---|---|---|
| 261967 | 2/1963 | Australia | 49/505 |

*Primary Examiner*—James L. Ridgill, Jr.
*Attorney, Agent, or Firm*—Helfgott & Karas

[57] ABSTRACT

A window and door trim which can be used with siding placed against the walls of a house. The trim includes elongated composite panels each comprising a receiving strip member and a facing strip member. The receiving member is formed with a folded hem having a receiving slot and has a flat portion securable to the front face of the window or door casing. The facing member is L-shaped. Its shorter leg is inserted in the receiving slot of the receiving member while its longer leg is adapted to enclose an end portion of the siding and be secured to the wall of the house. Corner trim arrangements and corner caps are also provided.

23 Claims, 4 Drawing Sheets

WINDOW AND DOOR TRIM FOR USE WITH SIDING

BACKGROUND OF THE INVENTION

The present invention relates to accessories for use with siding placed on a house, and more particularly to a window and door trim which can be used in conjunction with the siding.

Siding is used on houses to protect the outside of the house. Such siding is generally made of aluminum or vinyl material and is secured to the exterior of the house. Various types of moldings are required at the corners, edges adjacent the roof, and at other interconnecting locations.

Window and door trims for use with the siding have been proposed by the applicant, for example in U.S. Pat. No. 4,389,824. The window or door trim disclosed in this patent is comprised of two side panels, an upper panel and a windowsill covering. Each side and upper panel is comprised of a receiving strip which is attached to the inside wall of the window casing and an elongated L-shaped facing strip which is fitted around the casing. The receiving strip includes a spring-held receiving slot which receives a shorter leg of the L-shaped facing strip.

The problem with this otherwise satisfactory prior art window or door trim is that in order to attach the side receiving strip of the panels to the window casing it is necessary to dispose the receiving strip against the inner side wall of the window casing and secure the receiving strip wall to the inside casing wall by nails. Nailing takes place within a relatively small space of the window recess which leads to inconveniences. Likewise this arrangement can only be used where the window is received within a casing having an inner wall. It cannot be used for windows which are flush with the siding. Therefore there has been need to provide an improved window or door trim which could be secured to the window casing from the front face thereof.

While installing window trims it is often necessary to cut the trim to a desired length whereby resulting cut corners and edges make the window quite unaesthetic in appearance. J channels have been utilized in the prior art to finish off a window or door. Some installers have found J channels are also unaesthetic. Thus there has also been need to provide a window or door trim with finished off surfaces without however adding to costs and time for installation.

SUMMARY OF THE INVENTION

Accordingly, it is an object of the present invention to provide a window and door trim for use with siding being placed on a house.

It is a further object of the present invention to provide a window and door trim which protects the window or door casing against water penetration.

Yet another object of this invention is to provide a window and door trim in which side and upper panels are made of identical parts.

Still another object of the present invention is to provide a window and door trim which can be made of preprepared panels which are cut to a desired length before installation.

A further object of the present invention is to provide corner caps which would aesthetically cover cut corners and edges of the trim panels.

Yet another object of the present invention is to provide a windowsill covering for use in conjunction with a window and door trim for obtaining a completely finished off window or door.

Briefly, in accordance with the present invention there is provided a window or door trim for use with siding. The trim comprises elongated composite panels connectable to a window or door casing and each including a facing strip and a receiving strip. The receiving strip has a flat portion and a folded hem which extends substantially at right angles to the flat portion. The hem is folded so as to form at least one receiving slot. The facing strip is substantially L-shaped and has a shorter leg which is inserted into the receiving slot to position the facing strip relative to the receiving strip and secure the shorter leg of the facing strip to the receiving strip. The flat portion of the receiving strip is secured, for example, by nails, to the front face of the casing. The longer leg of the facing strip encloses an end portion of the siding. the longer leg terminates in a molding rim which provides a spring force to hold the facing strip onto the siding. The molding finishes off the aesthetic appearance of the trim. It can either be integral with the facing strip or snapped onto it.

In an embodiment, the receiving strip is also L-shaped and has a first leg having holes for receiving fastening means for securing the receiving strip onto the front of the casing and a second leg which is formed with the folded hem provided with the receiving slot.

In an embodiment, the hem on the receiving strip is multi-folded so as to form two receiving slots which are open in two opposite directions so that by inverting the receiving strip it can be used not only with recessed but also with non-recessed windows as well.

In an embodiment, an insulation gasket strip is positioned between the house wall and the receiving strip of the trim panel.

In an embodiment, the facing strip has an outwardly folded hem which forms the molding rim and can receive the projecting head of an L-shaped screw. The screw is twisted by pliers to lock the head into the folded hem and secure the facing strip to the siding.

In an embodiment, a corner cap is provided, which is placed over mitered corner edges of two adjacent trim panels to cover exposed cut edges thereof.

In an embodiment, the hem formed on the longer leg of the facing strip is provided with a hook at a free end thereof. The hook is engaged in an inwardly bent side portion of the corner cap when the corner cap is placed over the facing strip of the trim panel to lock the corner cap in place.

According to the present invention, a corner trim is also provided for use with the siding. The corner trim includes at least one inner corner member abutting against and attached to two adjacent house walls at their corner junction positioned underneath the siding. An outer corner member then overlays the end portions of adjacent siding meeting at the corner of the house. The inner corner member is provided with a receiving slot which receives a projecting wedge element provided on the outer corner member to snap the outer corner member in place.

The aforementioned objects, features and advantages of the invention will, in part, be pointed out with particularity, and will, in part, become obvious from the following more detailed description of the invention, taken in conjunction with the accompanying drawing, which form an integral part thereof.

DETAILED DESCRIPTION OF THE PREFERRED EMBODIMENT

Figure 1:
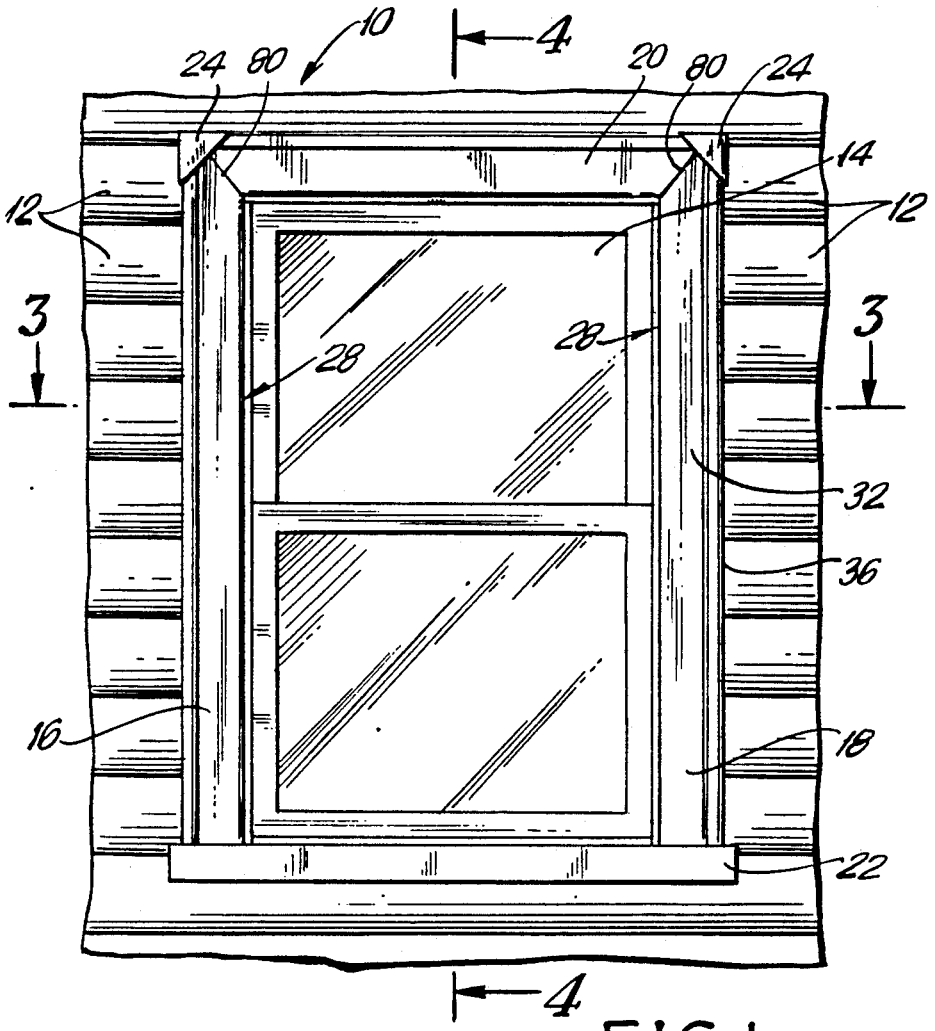
FIG. 1 is a front elevational view of a window of a house and including the trim, in accordance with the present invention.

Referring now to FIG. 1, there is shown a section of a house 10 on which there have been placed panels of siding 12. Siding panels are typically made of aluminum, vinyl or any other suitable material. A window 14 is trimmed with a window trim according to the present invention. The window trim will be described herein only as an example. It is, of course, understandable that the same type of the trim would be utilized in conjunction with a door molding. The trim comprises two parallel side panels 16, 18 interfit with an upper panel 20 and a windowsill covering 22. Two corner caps 24 are provided to cover the adjacent cut or mitered corners of the upper trim panel and the side trim panels. It should be understood that in case no ledge or windowsill is provided the upper trim panel may be utilized to trim the lower edge of the window.

Figure 2:
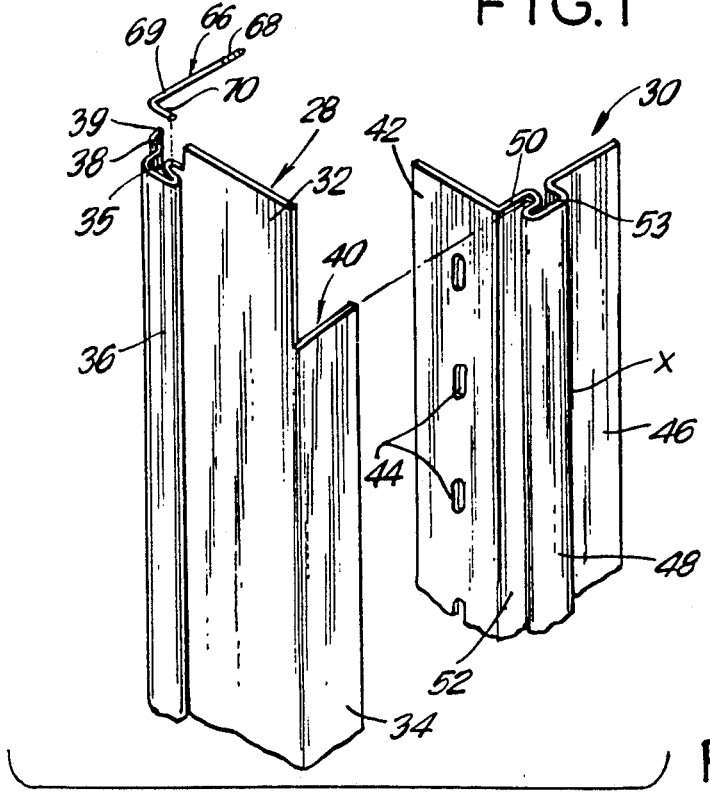
FIG. 2 is a perspective view of two sections forming the trim in accordance with an embodiment of the present invention.
Figure 3:
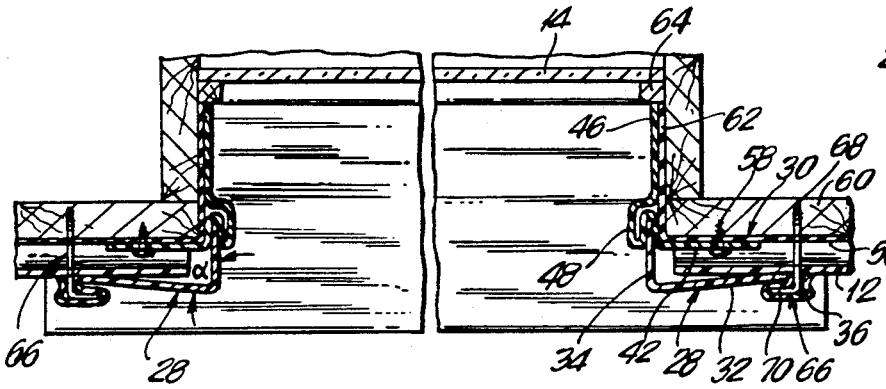
FIG. 3 is a cross-sectional view taken along line 3—3 of FIG. 1.
Figure 4:
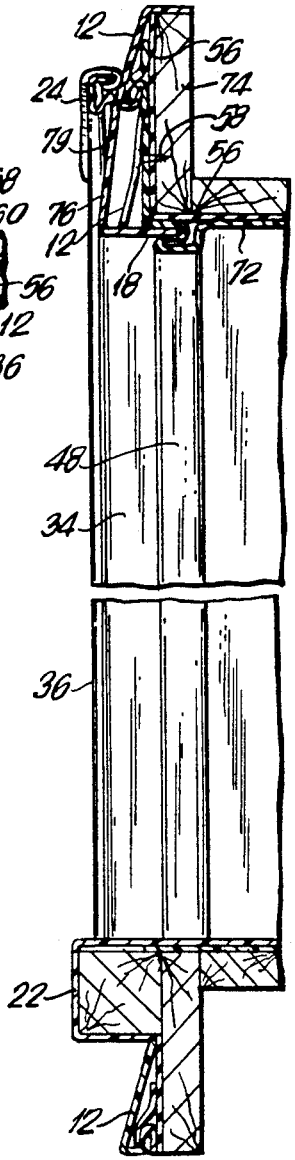
FIG. 4 is a cross-sectional view taken along line 4—4 of FIG. 1.

As can best be seen in FIGS. 2, 3 and 4, each side and upper panel of the trim is comprised of a first substantially L-shaped section which serves as a facing strip 28 and a second section which serves as a receiving strip 30. Facing strip 28 is a male section whereas receiving section 30 is a female section. The L-shaped facing strip 28 includes a longer leg 32 and a shorter leg 34 which is bent so as to include with longer leg 32 an angle a smaller than 90° as can be seen from FIG. 3. An angle of about 80° has proven to be the most satisfactory to ensure accommodation sufficient spring action on different window casing sizes.

The L-shaped facing strips can be initially provided in flat sheets and can be bent into an L-shaped configuration in situ by using a bending brake. However, preferably they come pre-shaped.

Figure 18:
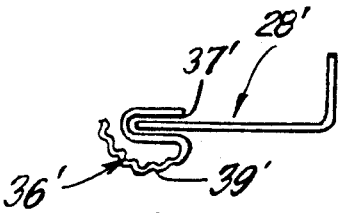
FIG. 18 is a top view of a facing strip with a snap-on molding edge.

The L-shaped facing strip 28 is further provided with a folded over hem 36 formed along the outer edge of longer leg 32 opposite to that of shorter leg 34. Hem 36 which is provided along the entire length of facing strip 28 is of a substantially C-shaped cross-section but has two outwardly bent edges 38, 39 also extending over the entire length of the facing strip. Such folded edges can be formed either by bending or by extrusion. The hems face forward on the edge of the leg 32 to provide a peripheral molding rim. It also provides rigidity to the strip and provides an integral molding which provides for an aesthetic appearance of completeness to the window. As seen in FIG. 18, instead of an integral molding rim, the facing panel 28' can use a snap on molding rim 36' provided with a receiving slot 37' to snap onto the edge of the facing strip and a decorative front 39'. This permits flexibility in selecting the desired molding for aesthetic appearance.

By making C-shaped hems or folds on each of the strips of the side trim or by using the snap-on moldings rigidity of the trim and thus of the outer edge of the window is significantly enhanced. At the same time, the hem will provide a slight pressure against the siding so as to retain the window trim securely against the siding. This pressure is increased due to the fact that the angle of the bend between the legs of the facing strip 28 is slightly less than 90° so the hem will exert a spring like pressure against the siding to prevent lifting up of the window trim from the siding. Further, the same molding serves as an aesthetic rim for finishing off the edges of the window trim.

A hook 39 is provided at the edge of the C-shaped hem 36. This hook is received in the channel of a corner cap as will be explained herein below.

When placing the side panel 28 in place, the shorter leg 34 is cut at its top to form notch 40. The shorter leg 34 fits onto the receiving slot on the side of the casing, leaving the front strip 32 extending upwards over the upper corner on the front of the window casing over which will be the mitered edge of the upper panel, as will hereinafter be explained.

The receiving member or strip 30 is also of a substantially L-shape and includes a substantially flat first leg 42 having longitudinally spaced-apart oblong holes 44 which receive nails to nail strip 30 to the window casing, and a second folded leg 46 extending normally to the flat portion 42. Second leg 46 of strip 30 has a hem or fold 48 of a substantially C-shaped cross-section and having two oppositely outwardly bent edges merging into opposing walls of leg 46. Folded hem 30 includes with the wall portion 50, a recess or slot 52 which in assembly receives the shorter leg 34 of the facing strip 28 as shown in FIG. 3. It should be appreciated that a rearwardly facing slot 53 is defined in between the hem, which will be discussed later.

The side trim panels each including the facing strip 28 and the receiving strip 30, which is the inner strip to be attached to the window casing, are installed on the window 14 as follows:

Initially receiving strips 30 are secured onto an insulating gasket strip 56 which extends around the entire window and is typically made of rubber, for example, EPDM rolled rubber. The installation of the rubber will be described hereinafter. The flat leg 42 of the receiving strip 30 is secured onto the front face of the gasket strip 46 and to the front face of the window casing 60 by nails 58 passing through holes 44. The advantage of such a construction resides in that the inner receiving strip 30 is nailed to the front side of the window, which provides more access to holes 44 than with conventional inner trim strips which have been nailed to the inside of the window casing from the lateral side thereof. As best seen in FIG. 3, after the receiving strip has been nailed to the front face of the window side casing 60, the shorter leg 46 of the receiving strip 30 is situated along an inner side wall 62 of the gasket strip 56. At this point the inner edge of the short leg 46 of receiving strip is trimmed by scissors to butt against a window stop 64. Thereafter the siding 12 is placed against the flat leg 42 of the receiving strip and secured to the house wall by any suitable fastening means, e.g. nails.

The facing strips 28 can then be installed by inserting its shorter leg 34 into the receiving slot 52 of the receiving strip 30. It is held by the tightness and the friction within the slot 52.

In order to better secure the facing strip 28 in place L-shaped screws 66 shown in FIG. 2 arè utilized. Screws 66 have a threaded end portion 68 on longer leg 69, and a shorter leg 70 bent at right angles to its longer leg 19. As seen in FIG. 2, after assembling the facing strip 28 with the receiving strip 30, the end 38 of the facing strip can be lifted and the screws 66 inserted beneath the rim 38. The shorter leg 70 of screw 66 is inserted into the fold formed by hem 36. The size of the hem 36 in the trim 38 is selected so that the shorter leg 70 of nail 66 is easily accommodated within such recess, as shown in FIG. 3, while its longer leg with its threaded portion is secured into the housing. To connect the strip 28 onto the screw 66, the screw is inserted into the siding panel 12 and the insulation or gasket strip 56 with the leg 70 directed vertically. It can then be inserted into the vertical mouth 35. By extending a pair of long nose pliers, or the like behind the strip leg 32 and twisting the longer leg 66 of the screw, the shorter leg 70 of the screw is turned horizontally to lock it within the slot of the hem 36.

It should be noted that all facing strips of the window trim overlie the siding and are attached in place after the siding has already been installed. As a result, rain falling along the surface of the siding will not have a chance to flow beneath the panels but on the contrary the flow of water will be on the outer surface of the trim without penetrating the siding panels.

Referring now to FIG. 4 it will be seen that the upper trim panel 20 is the same as the siding panels and is also comprised of a receiving strip 72 identical to the side of the receiving strip 30, and having the shorter leg thereof provided with spaced-apart elongated holes similar to holes 44 to receive nails 58 to secure the receiving strip 72 to the gasket strip 56 and to an upper casing 74 of the window casing. The siding panels 12 overlie the receiving strip 72.

A facing strip 76 of the upper trim panel, identified to the side facing strip 28 is then placed. The facing strip 76 is applied with its shorter leg 78 inserted into the recess or slot formed by the folded hem of the receiving strip 72 while a longer leg 79 of the facing strip 76 is placed to overlie the siding panels 12.

Referring back to FIG. 1 it will be seen that both side panels 16 and 18, at their respective upper corners, and the upper panel 20 at the edges thereof adjacent the side panels 16 and 18 provide an appearance of a mitered corner, as shown at 80. This can be achieved by having the side panels extending completely upwardly to the top of the window casing and only mitering the edges of the overlying top panel. Alternately both sides panels and top panels can be mitered and the abutting edges retained in place by using an adhesive tape under the abutting edges. The upper end of the mitered edges cuts through the molding rims. These are always difficult to cut smoothly because of their thickness and are therefore covered with corner caps 24 and 26, respectively, which will be explained in detail in reference to FIG. 12.

Figure 5:
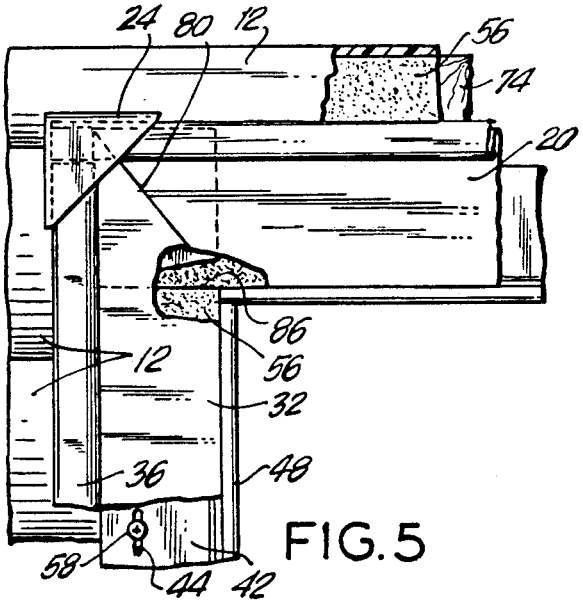
FIG. 5 is a front view of the window, partially broken away, and illustrating a left-hand upper corner of the window of FIG. 1.
Figure 6:
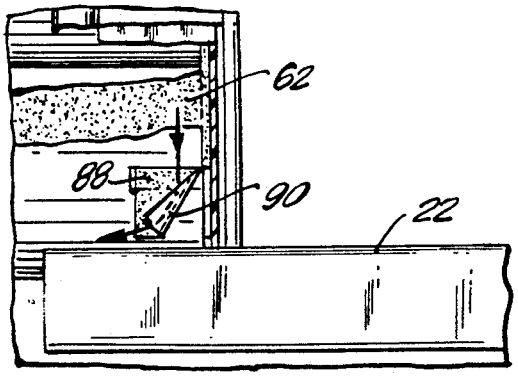
FIG. 6 is a front view of the window, partially broken away and showing a left-hand lower corner of the window of FIG. 1.

FIGS. 5 and 6 illustrate the installation of the rubber gasket 56 on the window casing and the positioning of the window trim panels over the rubber gasket. The rubber gasket 56 is installed over all sides of the window prior to installing of the aluminum or vinyl siding and trim panels 16, 18, 20 as described herein above. The rubber gasket typically made of rolled rubber under trademark the EPDM ® is secured around the window by nails. Sides of the window are trimmed by the rubber first; then the top rubber gasket is placed on the top of the window to overlie the side rubber pieces as shown at 86 in FIG. 5. The rubber is bent so as to cover the face 2 inside walls of the casing. The siding is then nailed onto the walls adjacent the window casing as described above. Adjacent the bottom sill, notches are cut into the siding to permit the rubber to pass through the siding. The bottom edges 88 of the rubber is then bent at 90 away from the window to form a water channel which would guide the water running down the window along the sill and thereby divert the water from penetrating the house wall.

Figure 7:
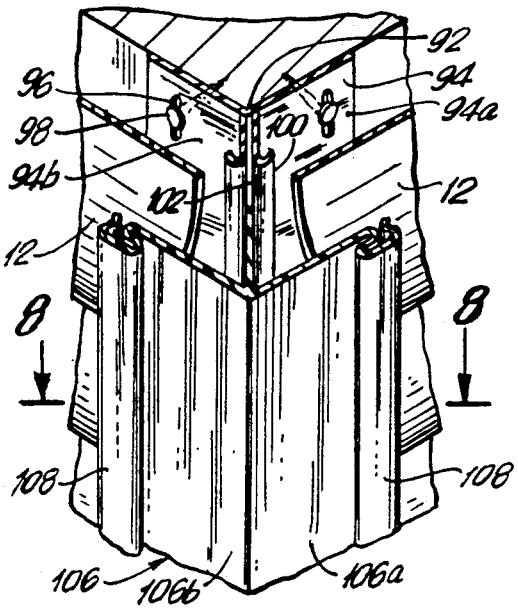
FIG. 7 is a partial perspective view of the corner of the house with the corner trim for the siding, according to the invention.
Figure 8:
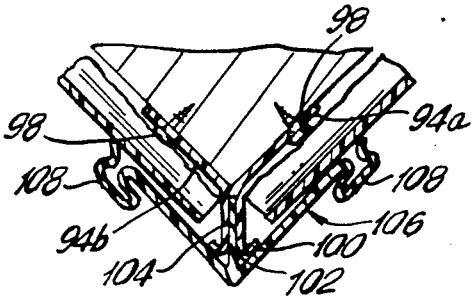
FIG. 8 is a cross-sectional view taken along line 8—8 of FIG. 7.

FIGS. 7 and 8 illustrate the construction and method of installation of a corner trim over the siding panels nailed to the house wall. As seen in the drawings prior to placing the siding panels 12 at each corner an inner corner strip element 94 is placed over the corner edge of the house and secured to the walls. The inner corner strip is typically extruded into a shape which includes two adjacent side walls **94*a* and 94*b* extending at right angles to each other. Each of these walls 94*a* and 94*b* has a number of spaced-apart elongated holes 96 which receive nails 98 to fasten the inner corner strip 94 to the corner of the house. Outwardly extending arms 100 define a slot 102 therebetween. The slot is tight in order to provide gripping capabilities therein. After placing the inner corner strip 94 on the house, the siding 12 can be connected to the house, adjacent the arms 100**.

An outer corner strip 106 is then applied. The outer corner strip also includes a pair of adjacent walls **106*a* and 106*b* which fit around the corner of the house and overlying the ends of the siding 12. Integrally formed at the inside angle between the walls 106*a* and 106*b* is a projecting wedge member 104 which is tightly inserted into slot 102 between the arms 100. At the outer ends of the walls 106*a* and 106*b* are the same type of molding rim 108 which was used with the panels of the window trim shown in FIG. 1. The use of this trim arrangement conceals all the edges of the siding panels 12** and provides a suitable aesthetic corner covering.

Figure 14:
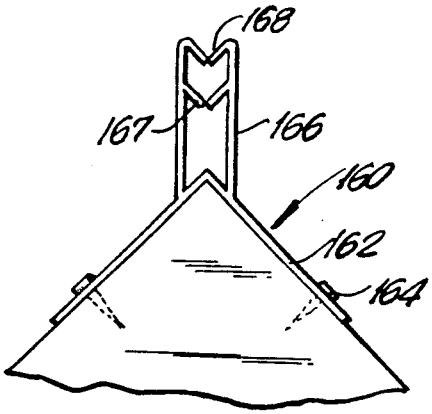
FIG. 14 is a plan view of a corner trim in accordance with another embodiment of the invention.

FIG. 14 shows a modified inner corner strip 160. The inner corner strip of this embodiment differs from that shown in FIGS. 7 and 8 in that two arms 166 extending outwardly from the walls 162 include inwardly bent gripping fingers 168 to help grasp the wedge member from the outer strip. The wedge member 104 of the outer corner member 106 shown in FIGS. 7 and 8 is wedged between the opposing fingers whereby the outer corner member would be locked in position to cover the cut edges of all corner siding panels in the manner shown in FIGS. 7 and 8. The walls 162 are secured by means of nails 164.

Figure 9:
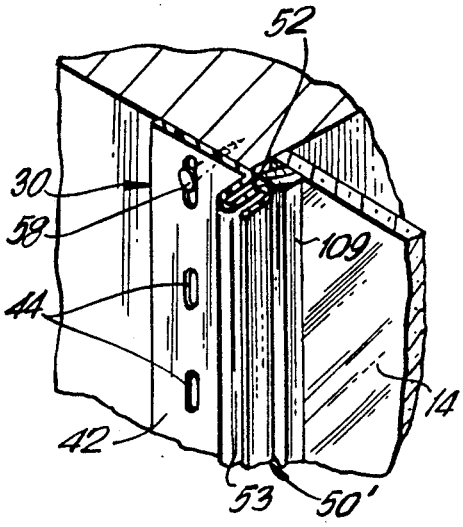
FIG. 9 is a partially broken-away perspective view of the flush window arrangement with a trim section according to another embodiment of the invention.

FIG. 9 shows the use of the receiving strip 30 of FIG. 2 in a situation where the window is flush with the wall and no inside casing exists. In this case the receiving strip 30 of FIG. 9 is cut along the outer edge of the hem 50 at a point designated as "X" in FIG. 2. The receiving strip is then inverted so that the slot 53 is open to the front and slot 52 opens to the rear. Double-folded hem 50 which is of S-shape in cross-section is placed against a wooden frame 109 of the window so that the slot 53 receives the bent leg of the facing strip 28 in the manner described in connection with FIGS. 2 and 3.

Figure 15:
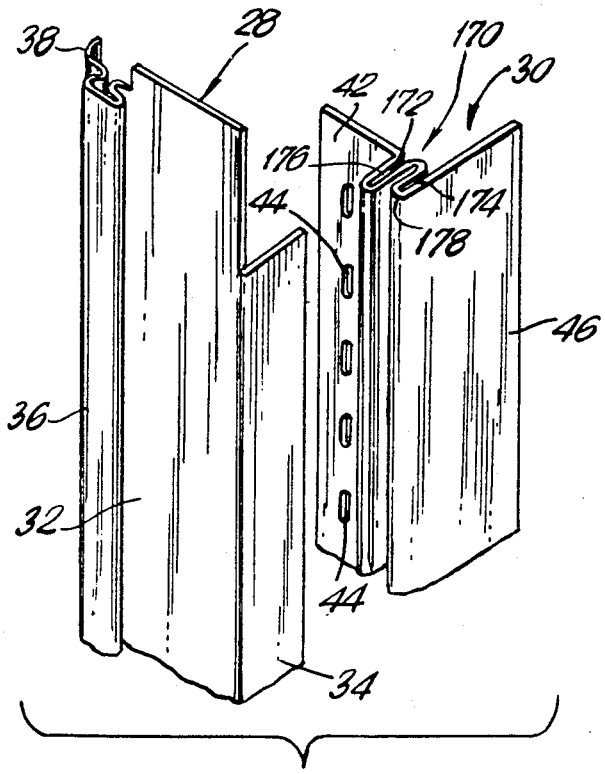
FIG. 15 is a perspective view of the window trim sections in accordance with a further embodiment.

FIG. 15 shows two trim strips of the side trim panel of a modified embodiment. L-shaped facing strip 28 is identical to that of FIGS. 2 and 3 whereas the receiving strip 30 is different from that shown in FIG. 2 and has a double folded intermediate portion 170 provided at connections between the first leg 42 having oblong holes 44 for passing nails therethrough and the second leg 46. Thus two receiving slots 172 and 174 which are open in two opposite directions are provided on the receiving strip 30. The left-hand fold 176 is stepped forwardly with respect to the right-hand fold 178. Both folds lie in a plane projecting forward of the plane of the leg 42. By using this arrangement, the fold 178 forms the slot for receiving leg 34 of the facing strip when utilizing a window casing of the type shown in FIGS. 1–7. However, when using a flush window without a casing, as in FIG. 9 all that is needed is to cut off the panel 46 from strip 30. However, it is no longer necessary to invert the strip 30, since the hems are already forward of the side wall 42.

Figure 10:
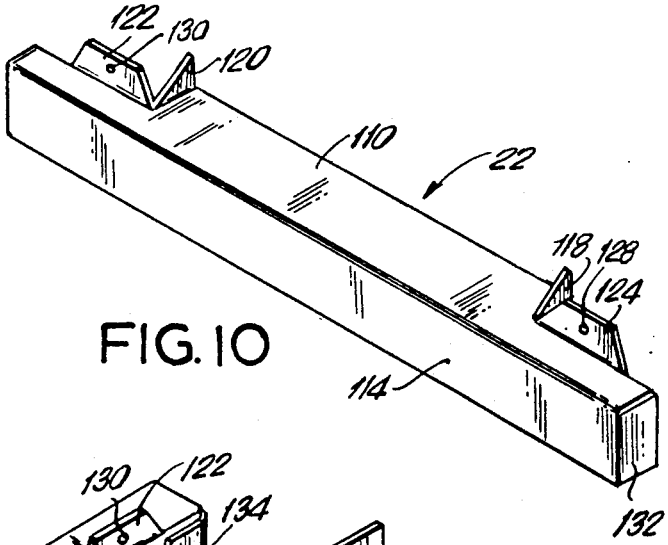
FIG. 10 is a perspective view of a sill covering as seen from the outside thereof.
Figure 11:
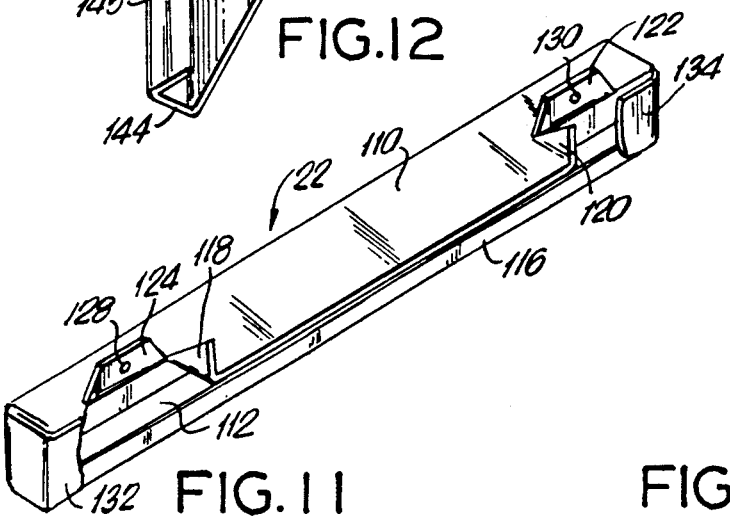
FIG. 11 is a perspective view of the sill covering of FIG. 10 and showing the inside of the covering.

As can best be seen in FIGS. 10 and 11, there is shown the windowsill covering 22 which is formed as an elongated member having a substantially U-shaped configuration including a longer leg 110 and a shorter leg 112 interconnected by a bight portion 114. An inwardly turned lip 116 extends from the distal edge of the shorter leg 112. At a distance from either end of the longer leg 110 the latter is cut at an angle so as to form the upwardly extended locating fingers 118, 120 of a triangular shape. The longer leg 110 is also provided with upwardly turned tabular sections 122, 124 of a trapezoidal shape. Triangular fingers 118, 120 are spaced apart a distance proximating the distance between the side trim panels. Tabular sections 122, 124 are positioned so as to face against the window side casing. Holes 128, 130 are formed in tabular sections 122, 124 for receiving therethrough any suitable fastening means to hold the sill covering in place.

The windowsill covering is greater in width than the window casing so as to completely cover the sill and extend slightly over the trim side panels 16, 18. Both ends of the windowsill covering 22 are closed off. Such closures can be formed by means of separately formed end caps or, alternately, by cutting and folding the ends to form integral closures 132, 134.

When installing the sill covering 22, as shown in FIG. 4, the leg 110 is placed over the bottom window sill and the upwardly protruding tabs 118, 120 will abut against the front face of the side casing to receive fastening means therein to secure the windowsill in place.

In placing the window sill cover, the lower ends of the side panels would be on top of the longer leg 110 of the windowsill covering.

The windowsill covering 22 can be formed with the longer leg 110 bent with respect to the bight portion 114 at an angle slightly greater than 90°. Due to such a construction, the water will flow down the side panels reaching the upper leg of the sill covering and off the sill covering either along its front or along its lateral sides.

Figure 12:
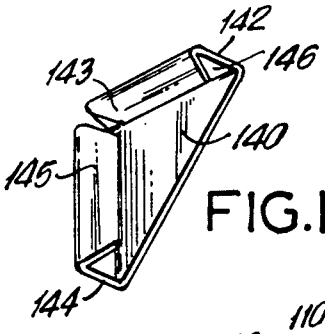
FIG. 12 is a perspective view of a corner cap according to the invention.
Figure 13:
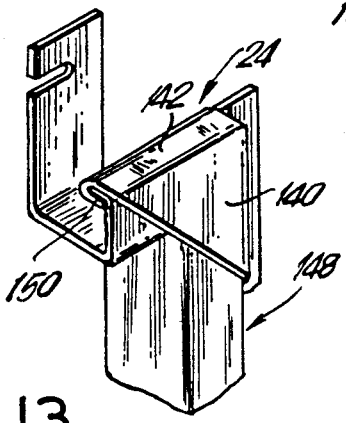
FIG. 13 is a perspective view of a J channel in assembly with the corner cap of FIG. 12.
Figure 17:
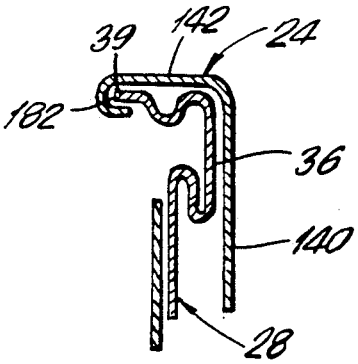
FIG. 17 is a cross-sectional view taken along line 17—17 of FIG. 16.

Referring now to FIG. 12, there is shown a corner cap 24. The corner cap can be made of the same material as that of all the panels of the window trim, for example, vinyl, aluminum or any other suitable material. Also, the materials can be intermixed. For example, a vinyl corner cap can be used with aluminum trim. Each cap is of a substantially triangular configuration and has a flat triangular cover wall 140 from which protrude two side walls 142 and 144, each wall is terminated with an inwardly bent edge, 143, 145. The bent edges can be of various shapes to accommodate the type of molding over which it fits. As shown in FIGS. 10 the edges are rather flat. FIG. 13 shows rounded edges and FIG. 17 shows a curved edge. Furthermore, the edges can be eliminated and the corner caps secured by adhesive rather than snap them in place.

Each cap 24 is placed over the exposed cut corners of the facing strips of two adjacent trim panels to conceal all cuts and edges of the molding rims, as shown in FIG. 5. Aluminum strips or bars, contoured to fit in channels 146 formed between the inner face of the flat wall 140 and each bent edge 143, 145, may be included to enhance its rigidity. The provision of the corner caps makes application of the trim panels effortless and significantly saves time to trim the window.

FIG. 13 shows that the corner cap 24 can also be placed on a J channel 148. J channels are conventional and are typically attached around the window frame with one leg of the channel being fastened directly to the frame. The J channel then forms a pocket for receiving the ends of the siding therein. One leg of the J channel is normally located beneath the siding. Corner cap 24 with its inwardly bent edges 143, 145 engages a bent edge 150 of the J channel and thus is securely locked in place to cover the exposed edge of the J channel.

Figure 16:
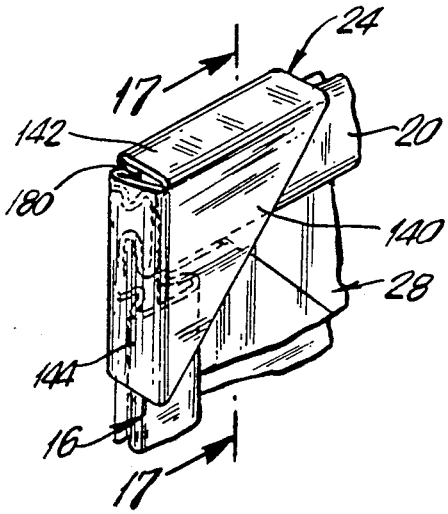
FIG. 16 is a perspective view of the corner cap set on two adjacent trim sections.

FIGS. 16 and 17 show the corner cap 24 placed on the corner of the window trim to cover the edges of the side trim panel 16 or 18 and the upper trim panel 20. Wall 142 is inclined relative to the flat wall 140 so as to leave an open space 180 between two side walls 142 and 144. Hook 39 of the C-shaped hem 34 of the upper facing strip is received in a channel 182 formed by the inwardly bent edge 143 while the entire hem of the upper panel as well as the hem of the side panel will be enclosed by the corner cap 24 which is snap-locked in its position over the trim edges by hook 39 and channel 182.

The material of the window trim may be either of aluminum, vinyl or other materials. It should be understood that the trim panels may be sold as long sheets with preprepared hems and can be cut to size to fit the desired sizes of windows and doors. Also, standard panels can be manufactured.

In installing the window trim, first the rubber gasket is installed around the windows, doors, or the like. The waterlap is created by installing the upper gasket over the lower side gaskets. A forced water pathway is created by folding the lower edges outward at the sill level. The siding is then installed up to about one row above the sill. The window sill is then installed over the siding. Notches are formed in the siding to pull through the folded edges of the rubber gasket.

The receiving strips are then installed. Notches are likewise formed in the receiving strips to accommodate the gasket flaps. The rearward part of the receiving strips are cut and butt the window or door stop. The sides are installed first and then the top last. The siding is then installed around windows and doors up to about 2" short.

The facing strips are then placed over the siding. The sides can be miter cut leaving extra material at the uppermost ends to serve as a pad for the last piece. The top strip is then cut and fit with mitered edges. The corner caps are then snapped into place. Some adhesive such as silicone caulk can be used to provide additional holding power.

There has been disclosed heretofore the best embodiments of the present invention presently contemplated. However, it is to be understood that modifications of the present invention can be made and are included within the scope of the invention.

What is claimed is:

1. A window and door trim for use with siding, comprising:

elongated composite panels connectable to a window or door casing at two sides and a top thereof, each panel including a facing strip, and a receiving strip, the receiving strip having a pair of walls forming a substantially L-shaped configuration and a folded hem formed at a junction between said walls, said hem forming at least one receiving slot, one of said walls being attachable to a front face of said casing, and another of said walls extending along an inside face of said casing when the trim is attached to the casing, said facing strip being substantially L-shaped and having a shorter leg insertable into said receiving slot to secure said facing strip with respect to said casing and a longer leg for overlying said one wall and the front face of said casing so that when the siding is installed, an inner end of said siding is enclosed between said receiving strip and said facing strip.

2. A window and door trim as in claim 1, wherein said hem lies along the other of said walls.

3. A window and door trim as in claim 1, wherein said one wall lies in a first plane and said trim extends forward of said first plane.

4. A window and door trim as in claim 1, wherein said one wall has a plurality of spaced-apart holes for receiving fastening means for attaching said one wall to said front face.

5. A window and door trim as in claim 1, wherein said shorter leg and said longer leg of said facing strip include therebetween an angle which is less than 90° for providing spring held abutment of said longer leg against a siding panel.

6. A window and door trim as in claim 1, wherein said hem is folded to provide two receiving slots which are open in two opposite directions and adapted to receive said shorter leg of said facing strip from two opposite sides of said receiving strip.

7. A window and door trim as in claim 1, wherein said trim includes an L-shape cross-section to define a pair of opposing slots each having a respective mouth opening in opposing directions to the other.

8. A window and door-trim as in claim 7, wherein a mouth opening adjacent said one wall opens toward that wall.

9. A window and door trim as in claim 7, wherein a mouth opening adjacent said one wall opens in a direction away from said wall.

10. A window and door trim as in claim 7, wherein said hem is provided on an external side of said other wall.

11. A window and door trim as in claim 1, wherein said facing strip has on said longer leg thereof a folded hem having a recess for accommodating fastening means for fastening said facing strip to the casing.

12. A window and door trim as in claim 11, wherein said folded hem is removable.

13. A window and door trim as in claim 1, and further comprising corner caps placed over a corner between an upper composite panel and a side composite panel.

14. A window and door trim as in claim 13, wherein said corner cap includes a substantially flat section of a triangular configuration and two adjacent side sections each having an inwardly bent portion.

15. A window and door trim as in claim 14, wherein said facing strip has on said longer leg thereof a folded hem extending along the length of said facing strip and terminated at a free end thereof with a hook portion, said hook portion being engageable in one of said inwardly bent portions of said corner cap when said cap is placed over said panels.

16. A window and door trim as in claim 1, wherein the casing includes a lower sill, and further comprising a lower still covering adapted for matingly interfitting with said composite panels placed on sides of the casing.

17. A window and door trim as in claim 16, wherein said sill covering includes an elongated substantially U-shaped member having a shorter leg and a longer leg and an upturned lip extending from an edge of the shorter leg.

18. A window and door trim as in claim 17, wherein the longer leg of said sill covering is cut to form upwardly extending locating fingers for fitting against an inside face of side portions of said casing and being positionable under said panels.

19. A window and door trim as in claim 1, and further comprising an L-shaped insulation gasket strip attached to said casing, each strip of each panel being attached to said casing to overlie said insulation gasket strip.

20. A window and door trim as in claim 19, wherein said insulation gasket strip has at an end portion thereof facing a windowsill a foldover portion forming a water channel.

21. A window and door trim as in claim 19, wherein said insulation gasket strip is made of rubber.

22. A window and door trim as in claim 21, wherein said rubber is EPDM rolled rubber.

23. A window and door trim for use with siding, comprising:

elongated composited panels connectable to a window or door casing at two sides and a top thereof, each panel including a facing strip, and a receiving strip, the receiving strip having a wall and a folded hem connected to said wall, said wall being attachable to a front face of said casing, said facing strip being substantially L-shaped and having a shorter leg and a longer leg for overlying the front face of said casing, wherein said hem is folded to provide two receiving slots which are open in two opposite directions and adapted to receive said shorter leg to secure said facing strip with respect to said casing, said shorter leg being insertable into either of said slots from two opposite sides of said receiving strip, whereby the same receiving strip can be utilized for recessed and non-recessed windows and doors by turning said strip over.

* * * * *